US006494256B1

(12) United States Patent
Achee, Jr. et al.

(10) Patent No.: US 6,494,256 B1
(45) Date of Patent: Dec. 17, 2002

(54) APPARATUS AND METHOD FOR ZONAL ISOLATION

(75) Inventors: Timothy T. Achee, Jr., Lafayette, LA (US); Joseph E. Hayes, Katy, TX (US); James Wenner, Houston, TX (US); Kerby J. Dufrene, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/922,033

(22) Filed: Aug. 3, 2001

(51) Int. Cl.[7] ..... E21B 43/04; E21B 3/18

(52) U.S. Cl. ..... 166/51; 166/227; 166/278; 166/334.4

(58) Field of Search ..... 166/51, 296, 227, 166/205, 142, 126, 128, 278, 334.4, 194, 115, 116, 373

(56) References Cited

U.S. PATENT DOCUMENTS 2,419,313 A * 4/1947 Byrd ..... 166/143
3,987,854 A * 10/1976 Callihan et al. ..... 166/278
4,372,384 A * 2/1983 Kinney ..... 166/278
4,401,158 A * 8/1983 Spencer et al. ..... 166/113
4,858,690 A * 8/1989 Rebardi et al. ..... 166/113
5,137,088 A * 8/1992 Farley et al. ..... 166/318
5,295,538 A * 3/1994 Restarick ..... 166/147
5,332,038 A * 7/1994 Tapp et al. ..... 166/123
5,579,844 A 12/1996 Rebardi et al.
5,609,204 A 3/1997 Rebardi et al.
5,988,285 A 11/1999 Tucker et al.
6,202,742 B1 * 3/2001 Echols ..... 166/158
6,216,785 B1 * 4/2001 Achee et al. ..... 166/278
6,302,208 B1 * 10/2001 Walker et al. ..... 166/278
6,382,319 B1 * 5/2002 Hill et al. ..... 166/194
6,427,775 B1 * 8/2002 Dusterhoft et al. ..... 166/236

* cited by examiner

*Primary Examiner*—Thomas B. Will
*Assistant Examiner*—Thomas A. Beach
(74) *Attorney, Agent, or Firm*—Williams, Morgan & Amerson; Jeffrey E. Griffin; Brigitte L. Jeffery

(57) ABSTRACT

A method and apparatus for isolating a completing and isolating a zone within a subterranean wellbore is disclosed. One embodiment of the present invention is a zonal isolation assembly for completing a first zone in a subterranean wellbore. The zonal isolation assembly comprises an inner housing and a sliding sleeve capable of moving between an open and closed position is disposed within the inner housing. A passageway provides fluid communication between the inside and outside of the inner housing and an isolation tubing element is at least partially disposed within the inner housing and capable of moving between an upper position and a lower position. When the sliding sleeve is in its closed position and the isolation tubing element is in its lower position, fluid communication from the first zone through the isolation assembly is restricted.

42 Claims, 9 Drawing Sheets

APPARATUS AND METHOD FOR ZONAL ISOLATION

BACKGROUND OF THE INVENTION

1. Field of the Invention

This invention relates generally to tools used to complete subterranean wells. More particularly the present invention describes a means of completing two zones within a single wellbore with the capability of isolating one of the zones.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses and can lead to a total loss of the well. One means of controlling sand production is the placement of relatively large sand (i.e., "gravel") around the exterior of a slotted, perforated, or other type liner or screen. The gravel serves as a filter to help assure that formation fines and sand do not migrate with the produced fluids into the wellbore.

In a typical gravel pack completion, a screen is placed in the wellbore and positioned within the unconsolidated formation that is to be completed for production. The screen is typically connected to a tool that includes a production packer and a cross-over, and the tool is in turn connected to a work or production tubing string. The gravel is mixed and pumped in a slurry down the tubing and through the cross-over, thereby flowing into the annulus between the screen and the wellbore. The liquid forming the slurry leaks off into the formation and/or through the screen, which is sized to prevent the gravel in the slurry from flowing through. The liquid that passes through the screen flows up the tubing and then the cross-over directs it into the annulus area above the packer where it can be circulated out of the well. As a result of this operation, the gravel is deposited in the annulus area around the screen where it forms a gravel pack. The screen prevents the gravel pack from entering into the production tubing. It is important to size the gravel for proper containment of the formation sand, and the screen must be designed in a manner to prevent the flow of the gravel through the screen.

In wellbores that penetrate more than one productive zone it is often desired to complete and produce more than one zone. In some cases more than one zone can be completed and produced together. This is often referred to as commingled production. In other cases, often due to differing reservoir characteristics such as formation pressures, two zones will be completed, but will be separated and produced through separate production strings. This is often referred to as a dual completion.

A common problem encountered when completing a well as a dual completion is a temporary commingling of the separate zones and the loss of substantial amounts of completion fluids into one or both of the formations, resulting in possible formation damage and requiring multiple trips into the wellbore to perform remedial treatments. The multiple trips and the remedial actions needed to reduce or remove formation damage can significantly increase the time and expense of dual well completions.

At times it is desirable to complete a zone and then isolate the zone until production is initiated or resumed at a later date. An example of this is when work is to be performed on the lower zone in a dual completion well; it may be beneficial to isolate the upper zone while the work is performed on the lower zone, both to increase safety during the well work and to reduce the chances of formation damage to the upper zone due to fluid loss. Zonal isolation systems are used to isolate and selectively produce oil or gas from separate zones in a single well. U.S. Pat. Nos. 5,579,844; 5,609,204 and 5,988,285 describe systems for the zonal isolation of wells. Often these systems involve multiple trips into the well and significant time and expense to perform. Any reduction in the number of trips required to complete a well or isolate a zone during subsequent operations can result in significant cost savings.

There is a need for improved tool assemblies and methods that enable the completing of a wellbore as a dual completion while reducing the chances of fluid loss into completed zones and enabling subsequent remedial work.

SUMMARY OF THE INVENTION

One embodiment of the present invention is a zonal isolation assembly for completing a first zone in a subterranean wellbore. The zonal isolation assembly comprises an inner housing and a sliding sleeve capable of moving between an open and closed position. The sliding sleeve is disposed within the inner housing. A passageway provides fluid communication between the inside and outside of the inner housing and an isolation tubing element is at least partially disposed within the inner housing and capable of moving between an upper position and a lower position. When the sliding sleeve is in its closed position and the isolation tubing element is in its lower position, fluid communication from the first zone through the isolation assembly is restricted.

The isolation tubing element can be releasably attached to the inner housing. The isolation tubing element can comprise a sealing element adapted to seat within a receptacle attached to a lower packer when the isolation tubing element is in its lower position. The receptacle can be releasably attached to the lower packer.

The assembly can further comprise an upper packer and an outer housing connected to the upper packer and to the lower packer. The outer housing can be connected to the inner housing and comprise a wall having a passageway therethrough, the outer housing and the passageway are located above the inner housing and below the upper packer. A sliding sleeve can be disposed within the outer housing capable of moving between an open and closed position and located above the inner housing. The outer housing can further comprise a sand screen located below the inner housing. The inner housing, isolation tubing element and receptacle can each be releasable disposed within the outer housing.

When the isolation tubing element is in its upper position, the isolation tubing element is capable of providing fluid communication between the area within the inner housing and the sand screen. When the isolation tubing element is in its lower position, the isolation tubing element is capable of providing fluid communication between the area within the inner housing and the area below the lower packer. When the isolation tubing element is in its lower position and the sliding sleeve disposed within the inner housing is in its closed position, fluid communication through the sand screen is restricted. When the isolation tubing element is in its lower position and the sliding sleeve disposed within the inner housing is in its closed position, the isolation tubing element is capable of providing fluid communication between the area within the outer housing located above the inner housing and the area below the lower packer.

When the sliding sleeve disposed within the outer housing is in its open position, fluid communication is capable through the passageway in the outer housing, and when the sliding sleeve is in its closed position, fluid communication through the passageway in the outer housing is restricted. When the sliding sleeve disposed within the outer housing is in its open position, fluid communication of a gravel laden slurry is permitted through the passageway in the outer housing. When the isolation tubing element is in its lower position, the sliding sleeve disposed within the inner housing is in its closed position, and the sliding sleeve disposed within the outer housing is in its closed position, the first zone of the wellbore is isolated from the wellbore located below the lower packer. When the isolation tubing element is in its lower position, the sliding sleeve disposed within the inner housing is in its closed position, and the sliding sleeve disposed within the outer housing is in its closed position, the first zone of the wellbore is isolated from the wellbore located above the upper packer.

The assembly can further comprise a gravel pack adapter releasably seated within the upper packer, the gravel pack adapter comprising a work string and a cross-over assembly, the work string being in fluid communication with the area within the outer housing above the inner housing, and the cross-over assembly being in fluid communication with the isolation tubing element. When the isolation tubing element is in its upper position, and the sliding sleeve disposed within the outer housing is in its open position, the gravel pack adapter work string is capable of communicating a gravel laden slurry through the passageway in the outer housing to the annulus area between the wellbore and the sand screen, and the cross-over assembly is capable of communicating slurry returns between the sand screen and the annulus area between the work string and the wellbore above the upper packer. The gravel pack adapter can be capable of shifting the sliding sleeve in the outer housing from an open position to a closed position upon the removal of the gravel pack adapter from the upper packer.

The assembly can further comprise a dual flow adapter releasably seated within the upper packer, the dual flow adapter comprising a first flow tubing and a second flow tubing. When the dual flow adapter is seated within the upper packer the first flow tubing is in fluid communication with the area within the outer housing above the inner housing and the second flow tubing is in fluid communication with the isolation tubing element. The dual flow adapter can be capable of shifting the sliding sleeve in the outer housing from an open position to a closed position when the dual flow adapter is inserted into the upper packer. When the isolation tubing element is in its lower position, the sliding sleeve disposed within the inner housing is in its open position, and the sliding sleeve disposed within the outer housing is in its closed position, the first zone of the wellbore is in fluid communication with the first flow tubing and the wellbore located below the lower packer is in fluid communication with the second flow tubing. The second flow tubing can be capable of shifting the sliding sleeve within the inner housing from an open position to a closed position when the second flow tubing is removed from the wellbore. The second flow tubing can be capable of shifting the sliding sleeve within the inner housing from a closed position to an open position when the dual flow adapter is placed within the upper packer.

Another embodiment of the invention is an assembly for completing a wellbore comprising an outer housing and an inner housing disposed within and attached to the outer housing. A first sliding sleeve is disposed within the outer housing capable of moving between an open and closed position and a second sliding sleeve is disposed within the inner housing capable of moving between an open and closed position. An isolation tubing is at least partially disposed within the inner housing and capable of moving between an upper and lower position. A sand screen is disposed within the outer housing and located below the inner housing. When the first sliding sleeve is in its open position, a path for fluid communication between the inside and the outside of the outer housing is created and is capable of passing a gravel pack slurry. When the isolation tubing is in its upper position, gravel pack fluid returns are capable of passing through the sand screen, through the isolation tubing and to the surface.

When the isolation tubing is in its lower position and the first and second sliding sleeves are in their closed positions, the sand screen is isolated from the wellbore above the gravel pack assembly. When the isolation tubing is in its lower position and the first and second sliding sleeves are in their closed positions, the sand screen is isolated from the wellbore below the gravel pack assembly.

Yet another embodiment is a method for completing a dual well comprising completing a lower zone below a lower packer. An upper zone completion assembly is provided comprising an upper packer, an outer housing comprising a gravel pack port, a sand screen and a seating element. An inner housing comprises a production port and an isolation tubing capable of moving between an upper position and a lower position and capable of seating within a receptacle attached to the lower packer. The upper zone completion assembly is seated within the lower packer, the isolation tubing being in its upper position. The upper packer is set and the upper zone is gravel packed by flowing a gravel slurry through the gravel pack port and taking fluid returns up through the isolation tubing. The upper zone is isolated from the rest of the well by closing the gravel pack port and the production port and by lowering and seating the isolation tubing within the lower packer receptacle. Fluid communication between the lower zone and the surface can be provided through the isolation tubing.

The method can further comprise inserting a dual flow adapter connected to a first tubing string and a second tubing string into the well and seating the dual flow adapter into the upper packer. Fluid communication can be provided between the first tubing string and the lower zone through the isolation tubing and fluid communication can be provided between the second tubing string and the upper zone through the production port within the inner housing.

Still another embodiment if the present invention is a method for isolating the upper zone in a dual completion wellbore. The method provides an upper zone completion assembly comprising an inner housing, having a production port and a sliding sleeve. The sliding sleeve is capable of moving between an open position and a closed position, wherein when the sliding sleeve is in its closed position, fluid communication through the production port is restricted. The upper zone is isolated by mechanically shifting the sliding sleeve from the open position to the closed position, thereby restricting fluid communication through the production port. When the upper zone is isolated, fluid communication between the wellbore below the upper zone completion assembly and the wellbore above the upper zone completion assembly is possible through the upper zone completion assembly. The method can further comprise reestablishing upper zone production capability by mechanically shifting the sliding sleeve from the closed position to the open position, thereby enabling fluid communication through the production port.

One particular embodiment of the invention is a subterranean wellbore completion and production method for an upper zone in a dual well. The method involves providing a completion assembly comprising an inner and outer housing, a first sliding sleeve and a sand screen disposed within the outer housing. A second sliding sleeve is disposed within the inner housing along with an isolation tubing capable of moving between an upper position and a lower position that is at least partially disposed within the inner housing. The completion assembly is positioned within the wellbore with the isolation tubing in its upper position. The well is gravel packed by flowing a gravel laden slurry through the first sliding sleeve and taking fluid returns up through the isolation tubing. The isolation tubing is then lowered to its lower position. The upper zone is isolated by having both the first sliding sleeve and the second sliding sleeve in their closed positions. The method can also comprise producing the upper zone through the sand screen and through the second sliding sleeve. The lower zone can be produced through the isolation tubing. The two zones can be produced separately by producing the upper zone through the sand screen and the second sliding sleeve, and a lower zone through the isolation tubing. The outer housing can be attached to and located below an upper packer and above a lower packer. When the isolation tubing is in its lower position it seats within a receptacle attached to the lower packer.

The method can further comprise providing a dual flow adapter connected to a first and second tubing strings. The dual flow adapter is inserted into the upper packer, wherein the second tubing string is seated within the inner housing. The upper zone can be produced through the sand screen, the second sliding sleeve, and the first tubing string. The lower zone can be produced through the lower packer, the isolation tubing, and the second tubing string.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
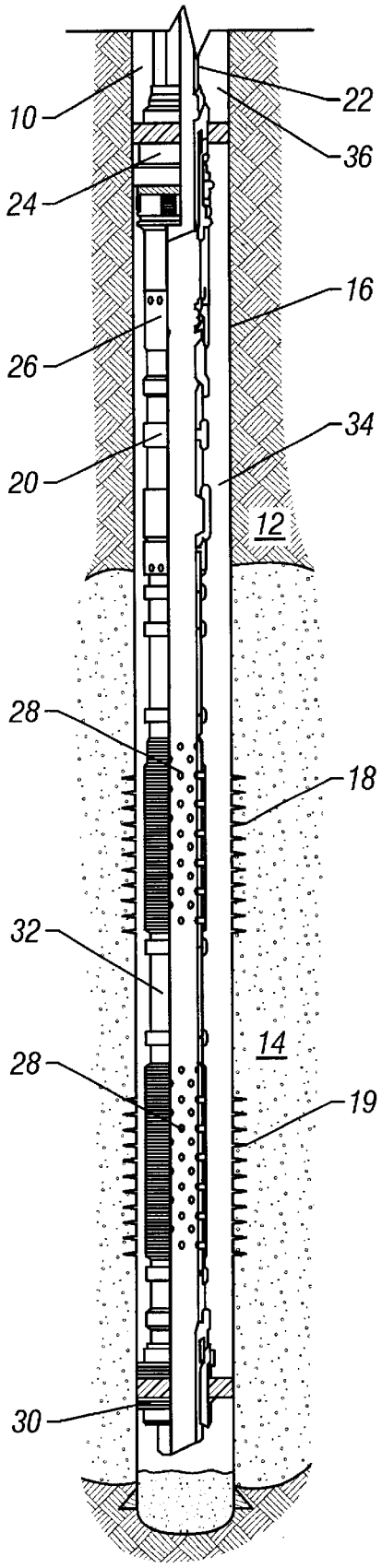
FIG. 1 (Prior Art)
FIG. 1 is a cross-sectional side view of a wellbore showing a typical gravel pack completion apparatus. This illustration is of prior art.

Referring to the attached drawings, FIG. 1 illustrates a wellbore 10 that has penetrated a subterranean zone 12 that includes a productive formation 14. The wellbore 10 has a casing 16 that has been cemented in place. The casing 16 has an upper set of perforations 18 and a lower set of perforations 19 which allow fluid communication between the wellbore 10 and the productive formation 14. A well tool 20 is positioned within the casing 16 in a position adjacent to the productive formation 14, which is to be gravel packed.

The present invention can be utilized in both cased wells and open hole completions. For ease of illustration of the relative positions of the producing zones, a cased well having perforations will be shown.

The well tool 20 comprises a tubular member 22 attached to a production packer 24, a cross-over 26, and one or more screen elements 28. The tubular member 22 can also be referred to as a tubing string, coiled tubing, workstring or other terms well known in the art. Blank sections 32 of pipe may be used to properly space the relative positions of each of the components. An annulus area 34 is created between each of the components and the wellbore casing 16. The combination of the well tool 20 and the tubular string extending from the well tool to the surface can be referred to as the production string. FIG. 1 shows an optional sump packer 30 located below the lower set of perforations 19.

In a gravel pack operation the packer element 24 is set to ensure a seal between the tubular member 22 and the casing 16. Gravel laden slurry is pumped down the tubular member 22, exits the tubular member through ports in the cross-over 26 and enters the annulus area 34. In one typical embodiment the particulate matter (gravel) in the slurry has an average particle size between about 40/60 mesh–12/20 mesh, although other sizes may be used. Slurry dehydration occurs when the carrier fluid leaves the slurry. The carrier fluid can leave the slurry by way of the perforations 18, 19 and enter the formation 14. The carrier fluid can also leave the slurry by way of the screen elements 28 and enter the tubular member 22. The carrier fluid can flow up through the tubular member 22 until other ports within the cross-over tool 26 places it in the annulus area 36 above the production packer 24 where it can leave the wellbore 10 at the surface. Upon slurry dehydration, the gravel grains should pack tightly together. The final gravel filled annulus area is referred to as a gravel pack.

As used herein, the term "screen" includes wire wrapped screens, mechanical type screens and other filtering mechanisms typically employed with sand screens. Sand screens need to have openings small enough to restrict gravel flow, often having gaps in the 60–120 mesh range, but other sizes may be used. The screen element 28 can be referred to as a sand screen. Screens of various types are produced by US Filter/Johnson Screen, among others, and are commonly known to those skilled in the art.

Figure 2:
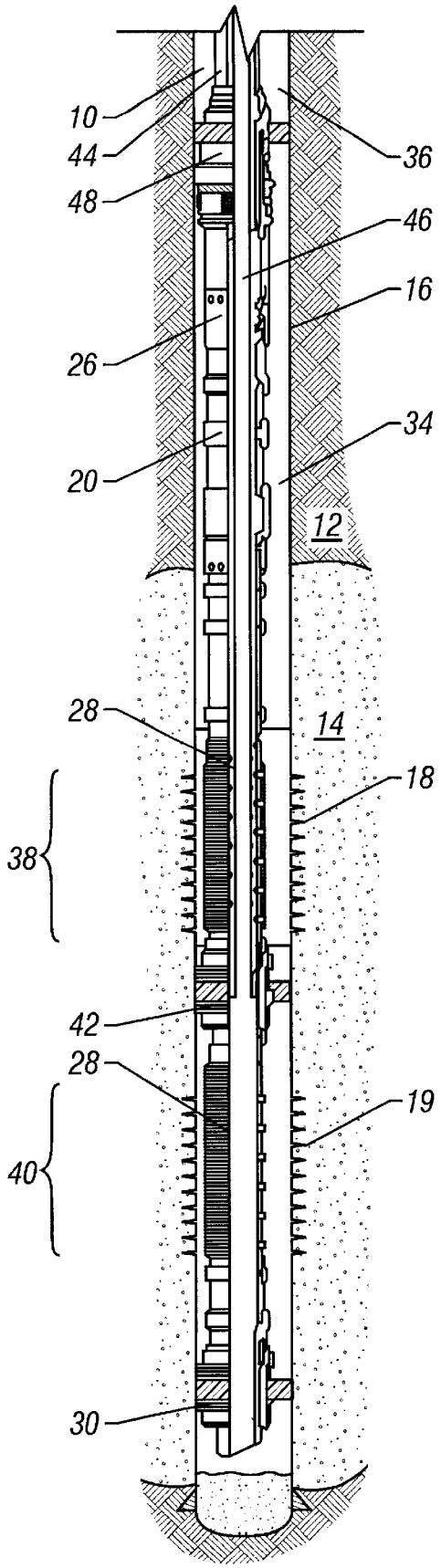
FIG. 2 (Prior Art)
FIG. 2 is a cross-sectional side view of a wellbore showing a typical dual zone gravel pack completion. This illustration is of prior art.

FIG. 2 illustrates a wellbore wherein an upper zone 38 and a lower zone 40 are each perforated and gravel packed and are separated by a lower packer 42. This configuration will enable the upper zone 38 to be produced through a first tubing string 44 and the lower zone 40 to be produced through a second tubing string 46. A dual packer 48 that provides for both tubing strings 44, 46 is used in conjunction with the lower packer 42 to provide separation of the two zones.

Figure 3:
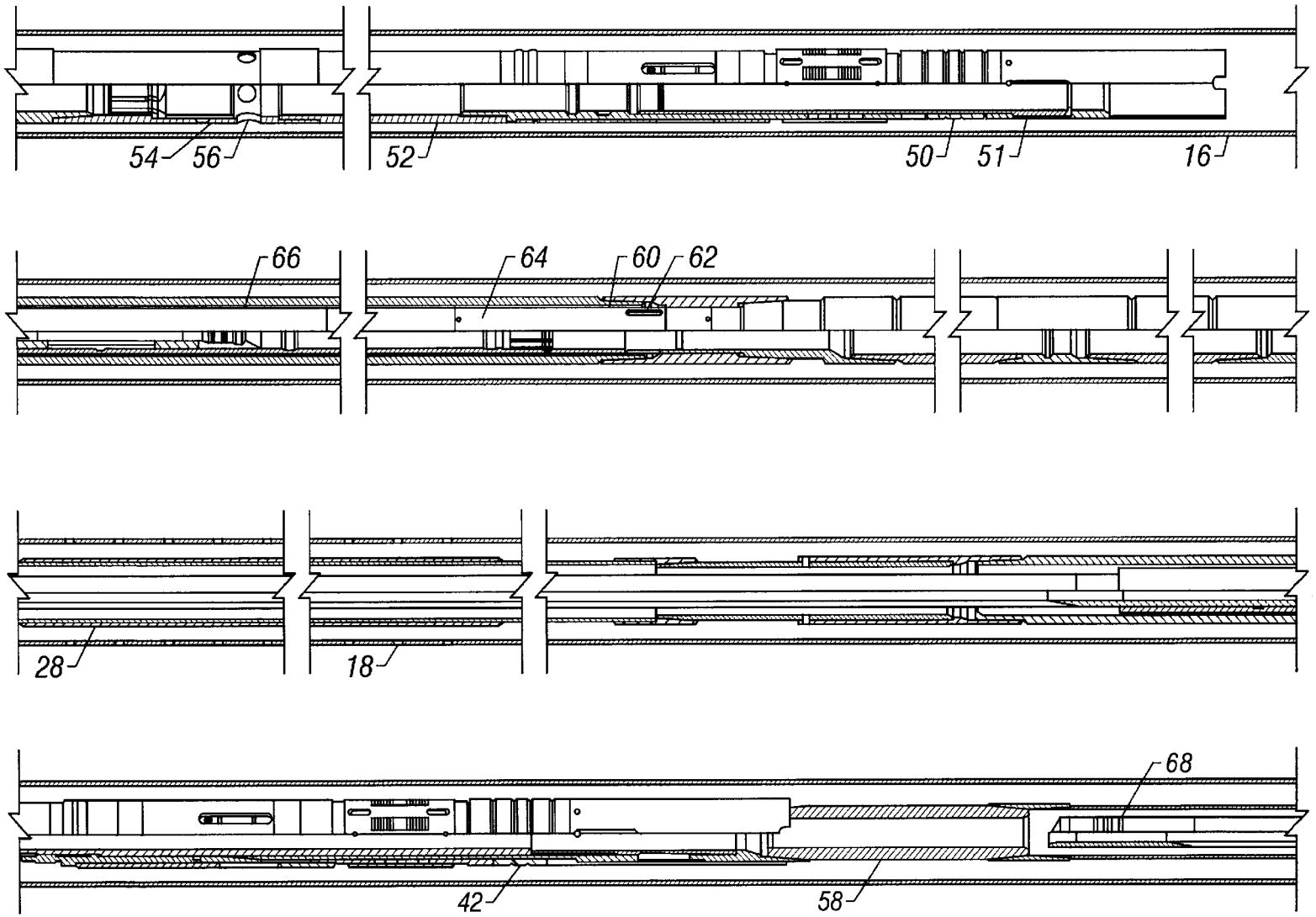
FIG. 3 is a cross-sectional side view of an embodiment of the present invention.

FIG. 3 shows a cross-sectional side view of an embodiment of the present invention. A well casing 16 having an upper set of perforations 18 has a lower packer 42 set within the casing 16 below the upper set of perforations 18 and above a lower set of perforations (not shown). An upper packer 50 is set in the casing 16 above the upper perforations 18. The upper packer 50 comprises a seating element 51 that is capable of engaging with a tool inserted into the upper packer 50 and forming a sealing contact with the tool. Various tools can be inserted into the upper packer 50 for different purposes, such as, for gravel packing, actuating other downhole equipment, and to enable production from one or more completed formations.

Attached beneath the upper packer 50 is a housing 52 that comprises a first sliding sleeve 54. The first sliding sleeve 54 is movable between an open position and a closed position and acts to open or close a first passageway 56 through the housing 52. The housing 52 also comprises a screen 28 located below the first sliding sleeve 54 and a polished bore receptacle 58 (also referred to as a PBR) located below the screen 28. The lower end of the housing 52 is adapted to attach to or seal within the lower packer 42. Located within the housing 52 is an inner housing 64 having a second sliding sleeve 60 capable of moving between an open and closed position. The second sliding sleeve 60 is capable of opening or closing a second passageway 62 through the inner housing 64. Also located within the housing 52, and at least partially disposed within the inner housing 64, is a lower zone isolation tool 66 capable of being in an upper position and a lower position. The lower end of the lower zone isolation tool 66 comprises a sealing element 68 that is adapted to seal within the PBR 58 when the lower zone isolation tool 66 is in its lower position.

An alternate embodiment can have the PBR 58 as an integral part of the lower packer 42. The lower packer 42 can also comprise a valve (not shown), such as a flapper valve, that isolates the wellbore below the lower packer 42 from the wellbore above the lower packer 42. This valve can be opened by hydraulic force or mechanically when the lower zone isolation tool 66 is seated within the PBR 58.

Other alternate embodiments can have the inner housing 64 and lower zone isolation tool 66 as retrievable elements disposed within the housing 52. The PBR 58 can likewise be made a retrievable element within the housing 52 or the lower packer 42. These embodiments enable the removal of one or more of these elements from the wellbore 10 while leaving the housing 52 and screen assembly 28 within the wellbore 10. These embodiments can be achieved using additional polished bore receptacle/seating tool assemblies, by safety release subs, or by other means known to those skilled in the art.

A safety release sub (not shown) can be incorporated within the assembly below the PBR 58 to enable the releasable attachment of the inner housing 64, lower zone isolation tool 66 and the PBR 58 to the housing 52. The lower zone isolation tool 66 can also be releasably attached within the inner housing 64, enabling its removal independent of the inner housing 64.

Figure 4:
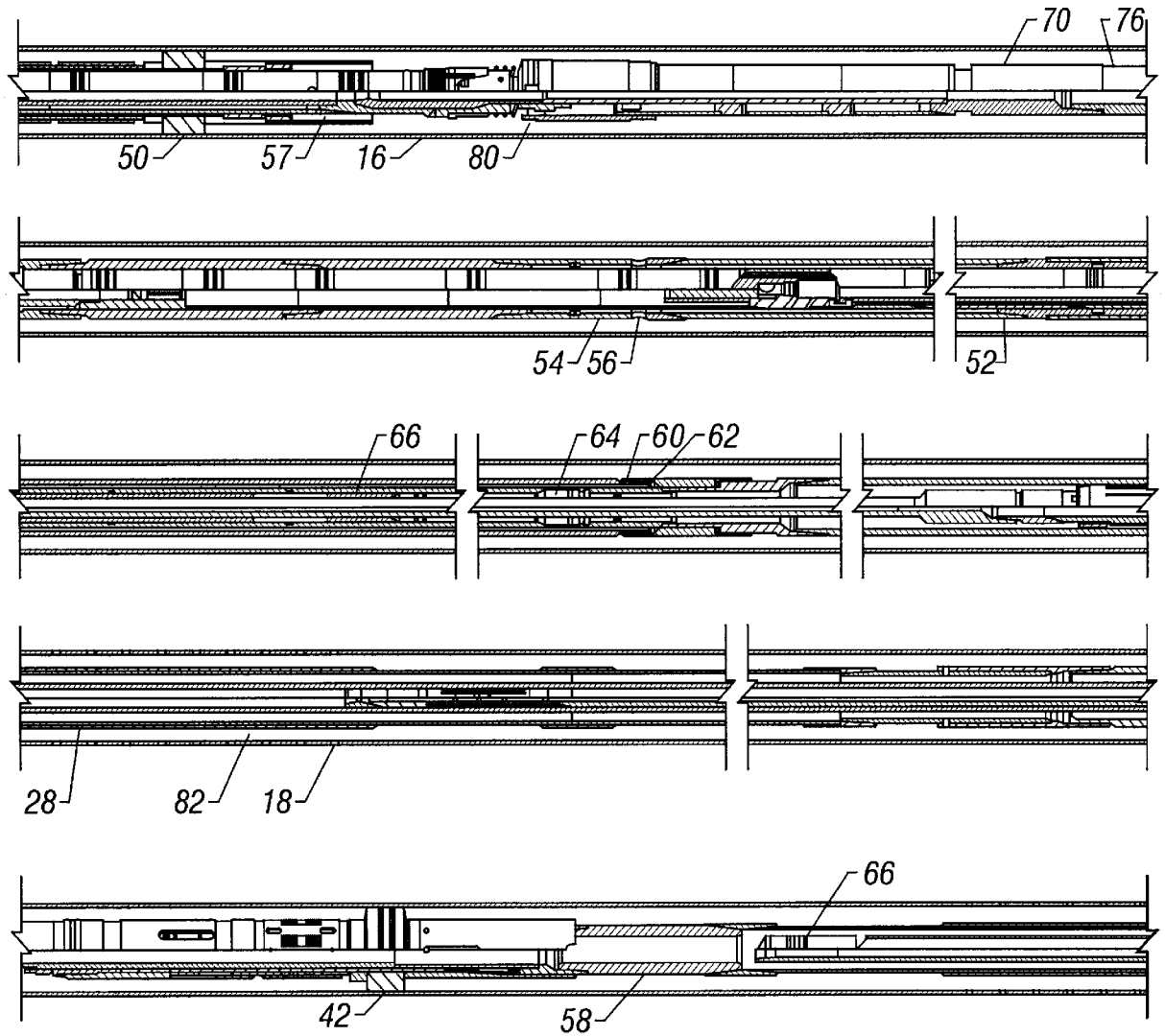
FIG. 4 is a cross-sectional side view of another embodiment of the present invention.

FIG. 4 illustrates an embodiment of the invention having a configuration that will enable a gravel pack operation to be performed. A gravel pack tool 70 is inserted into the upper packer 50. The gravel pack tool 70 is attached to a work string 76 that extends to the surface. The first sliding sleeve 54 is in its open position, thereby providing fluid communication between the work string 76 and the annulus area 82 between the screen 28 and the upper set of perforations 18.

The first sliding sleeve 54 could have initially been in its closed position, and could have been opened by the attachment of the gravel pack tool 70 into the upper packer 50. This opening of the first sliding sleeve 54 can be achieved through the use of a collet shifting mechanism or other means known to those of ordinary skill in the art.

The second sliding sleeve 60 is in its closed position, restricting flow through the second passageway 62. The lower zone isolation tool 66 is in its upper position thereby providing fluid communication between the inside of the screen and the annulus area 80 above the upper packer 50. The first sliding sleeve 54 and the first passageway 56 can be a portion of a cross-over tool (such as item 26 shown in FIG. 1). The gravel pack tool 70 comprises a cross-over assembly that includes ports 57.

Figure 5:
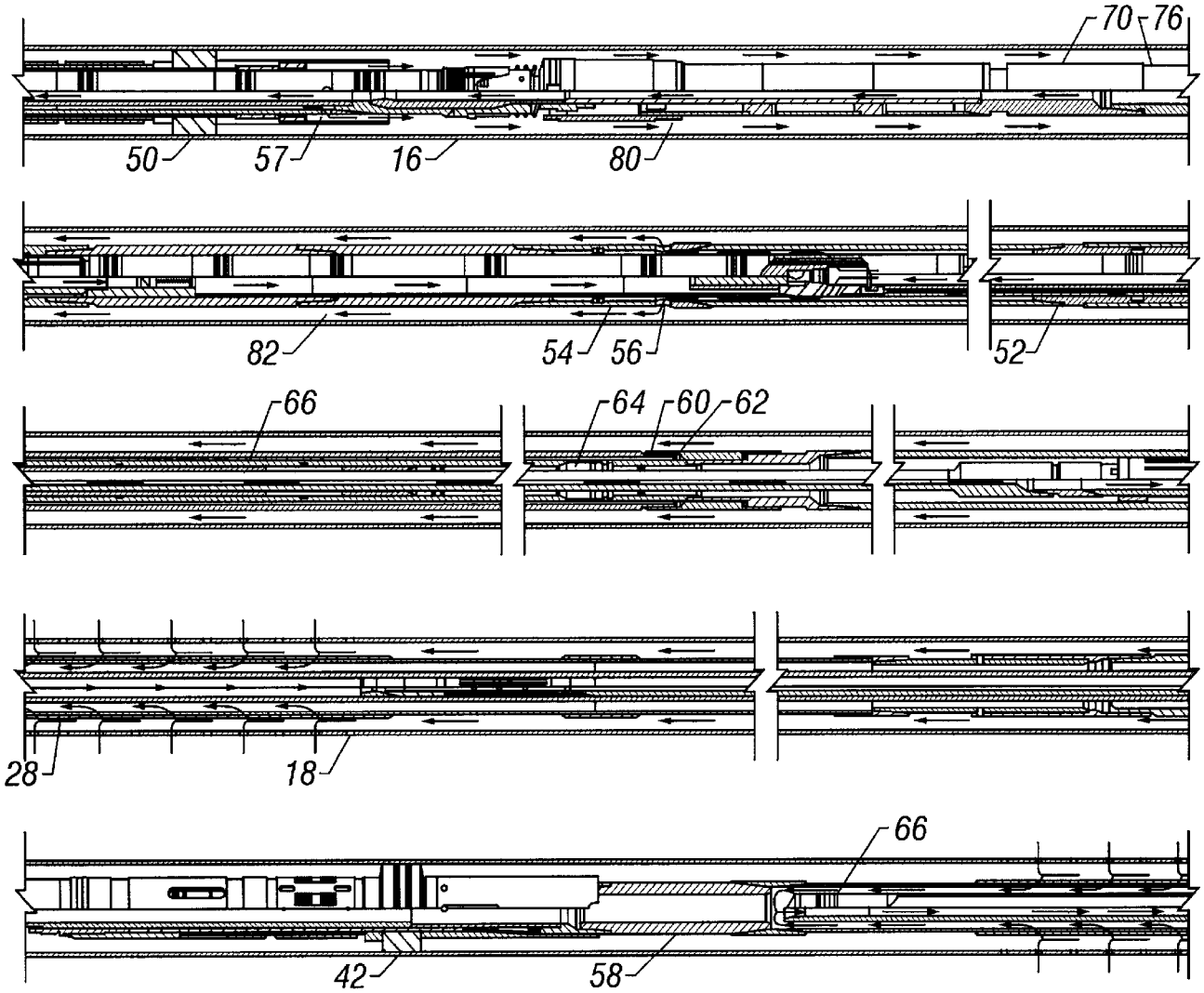
FIG. 5 is a cross-sectional side view of an embodiment of the present invention showing the flow of fluids during a gravel pack completion.

FIG. 5 shows the flow path as the gravel pack slurry is pumped down the work string 76, through the first passageway 56 to the annulus area 82 between the housing 52 and the casing 16. The gravel will be deposited within the annulus area 82, while the fluid from the slurry will be able to flow through the screen 28, through the lower zone isolation tool 66 and through upper ports 57 of the cross-over tool to the annulus area 80 above the upper packer 50 where it can be circulated to the surface and out of the well 10. The second sliding sleeve 60 is in its closed position restricting flow through the second passageway 62.

Figure 6A:
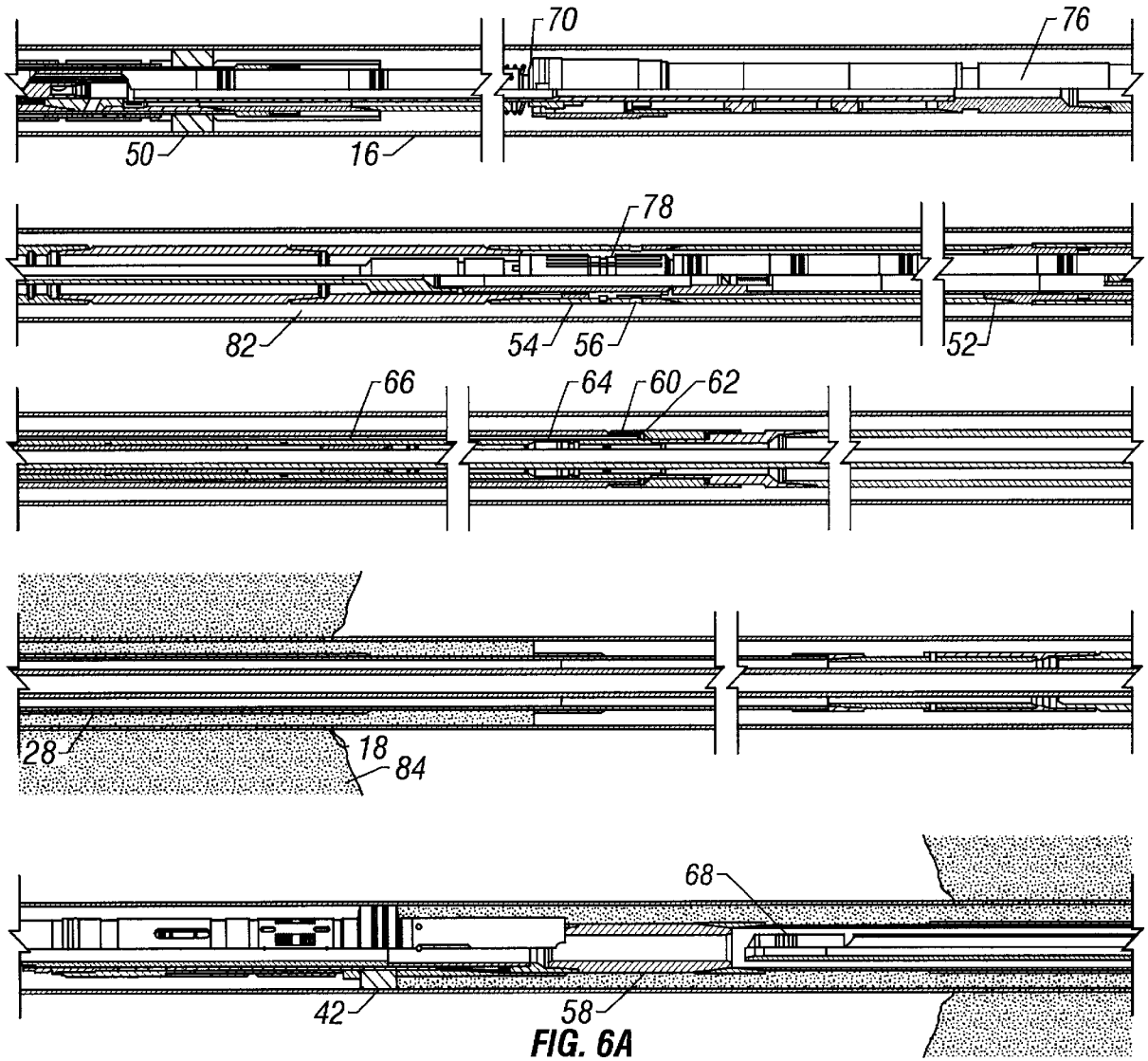
FIG. 6A is a cross-sectional side view of an embodiment of the present invention illustrating the placement of gravel after a successful gravel pack operation.

FIG. 6A shows a gravel pack 84 placed within the annulus area 82 adjacent to the perforations 18 and the screen 28. Once the gravel pack 84 has been placed, the gravel pack tool 70 can be utilized to shift the first sliding sleeve 54 to the closed position. This embodiment shows a shifting collet mechanism 78 being utilized to shift the first sliding sleeve 54 closed, thus restricting flow through the first passageway 56.

Figure 6B:
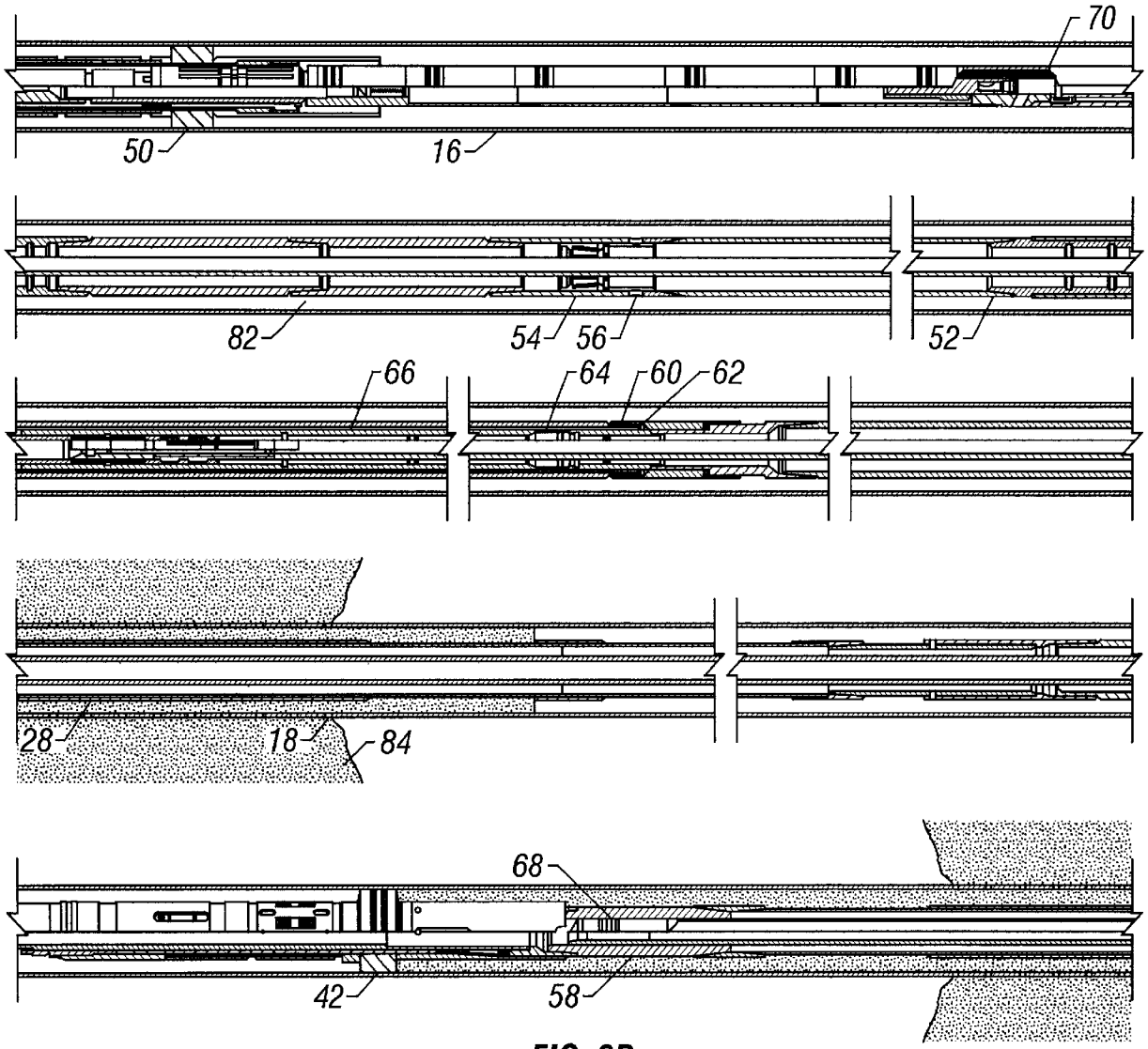
FIG. 6B is a cross-sectional side view of an embodiment of the present invention illustrating the placement of gravel after a successful gravel pack operation and the shifting of the isolation tool.

FIG. 6B shows how further movement of the gravel pack tool 70 can shift the lower zone isolation tool 66 to its lower position, seating the sealing element 68 within the PBR 58. These shifting of positions can be performed using shifting collet mechanisms, shear elements or by other means known to those skilled in the art. The closing of the first sliding sleeve 54 restricts flow through the first passageway 56 and the shifting of the lower zone isolation tool 66 to its lower position seats the sealing element 68 within the PBR 58, thus isolating the upper perforations 18 from the wellbore below the lower packer 42.

Figure 7:
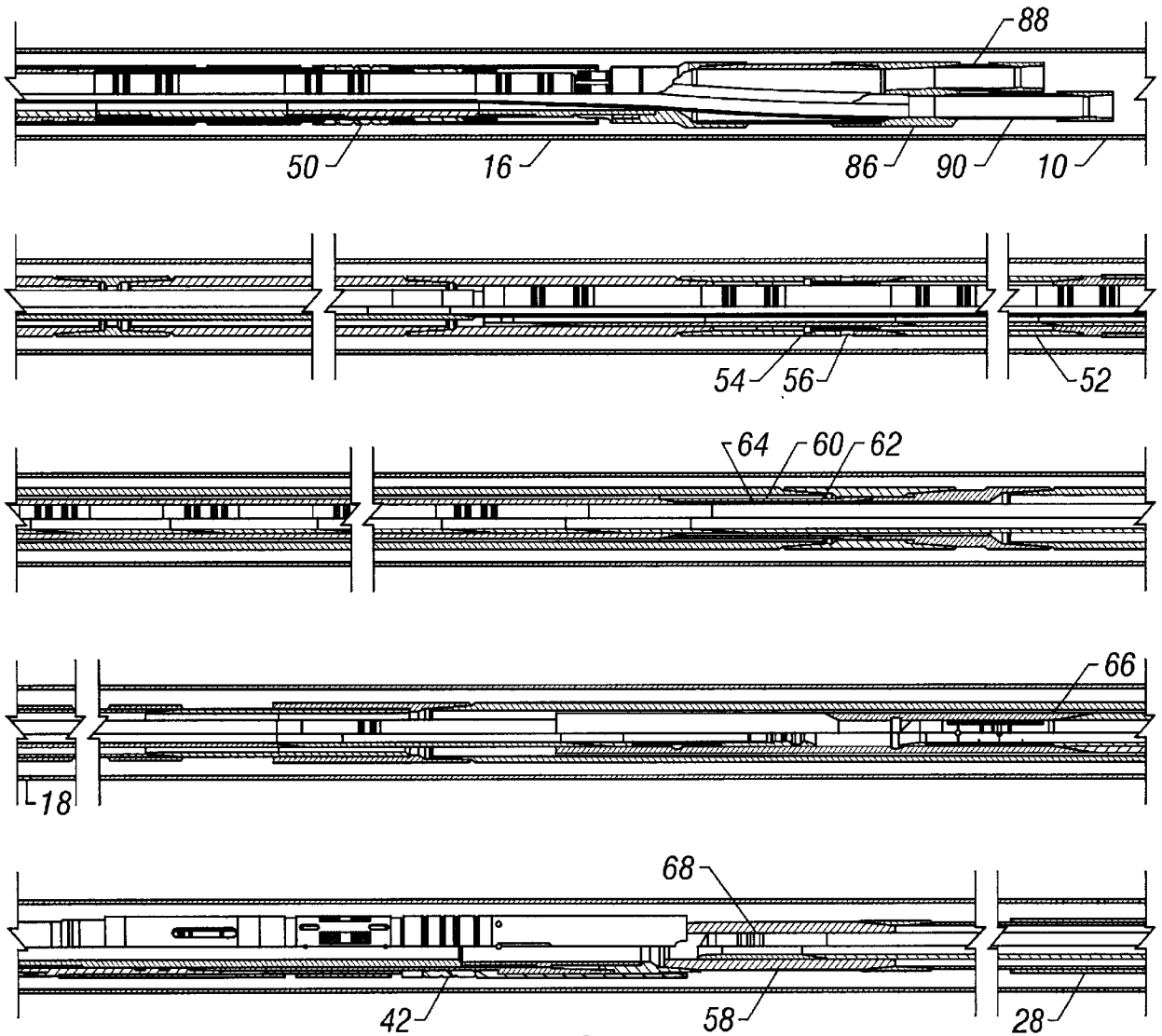
FIG. 7 is a cross-sectional side view of an embodiment of the present invention showing the segregated production from upper and lower zones.

FIG. 7 illustrates an embodiment of the present invention in which a dual tubing adaptor 86 has been inserted into the well 10 and seated within the upper packer 50. The dual tubing adaptor 86 enables a tubular string extending from the surface, referred to as the short string 88, to be in fluid communication with the upper set of perforations 18. Another tubular string extending from the surface, referred to as the long string 90, is in fluid communication with the lower set of perforations (not shown). The lower set of perforations (not shown) can be produced through the lower zone isolation tool 66 and through the long string 90 to the surface. The spacing of the long string 90 to establish communication with the lower zonal isolation tool 66 can also be used to shift the second sliding sleeve 60 to its open position, thus enabling fluid communication through the second passageway 62.

The upper set of perforations 18 can be produced through the screen 28, through the second passageway 62 in the inner housing 64 (since the second sliding sleeve 60 is in its open position), and through an area within the outer housing 52 and outside of the long string 90, until it enters and passes through the short string 88 to the surface. The first sliding sleeve 54 is in its closed position, which restricts flow through the first passageway 56 and forces the production from the upper set of perforations 18 to pass through the sand screen 28 and the path described above.

The dual tubing adaptor 86 can be removed from the well 10. This can be done to enable remedial work to be performed on the lower zone or for other reasons. As the dual tubing adaptor 86 is removed from the well, the extended long string 90 can be utilized to shift the second sliding sleeve 60 from its open position to its closed position, thus restricting flow through the second passageway 62. This shifting of the second sliding sleeve 60 can be performed using a shifting collet mechanism and shear elements or by other means known to those skilled in the art.

Figure 8:
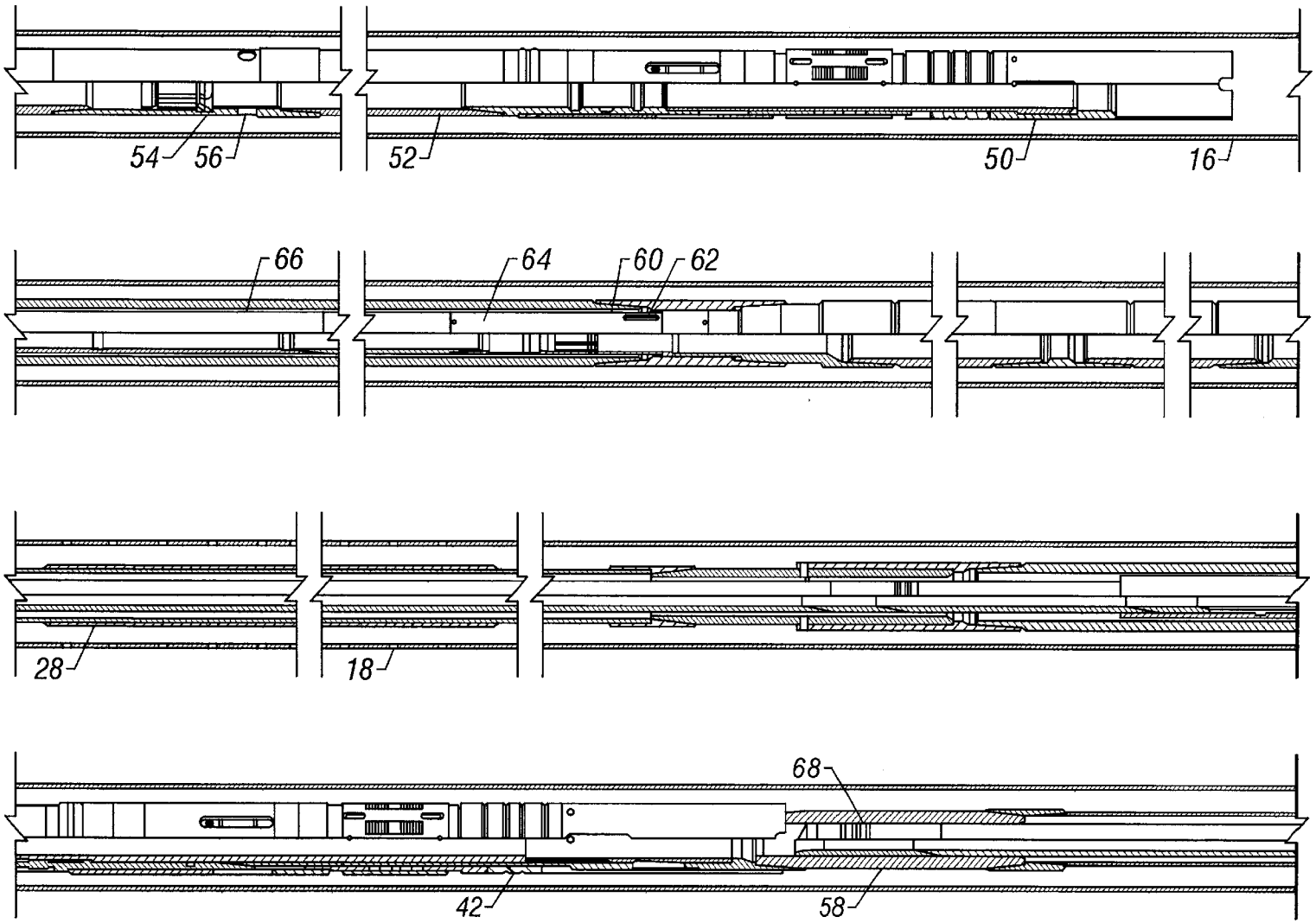
FIG. 8 is a cross-sectional side view of another embodiment of the present invention wherein the upper zone is isolated and the lower zone is available for production or remedial treatment.

FIG. 8 shows an embodiment of the invention in which the second sliding sleeve 60 is in its closed position, restricting flow through the second passageway 62. The lower zone isolation tool 66 is in its lower position, its sealing element 68 seated within the PBR 58. The first sliding sleeve 54 is in its closed position, thus restricting flow through the first passageway 56. This configuration isolates the upper set of perforations 18 between the upper packer 50 and the lower packer 42.

In this configuration the lower set of perforations (not shown) located below the lower packer 42, are in fluid communication through the isolation tool 66, through the inside of the inner housing 64 and outer housing 52, through the upper packer 50 and to the surface. As long as the upper packer 50 and lower packer 42 are set within the casing 16 and sealing off any annular flow, the lower zone can be worked over or produced without any interference or commingling with the upper set of perforations 18.

One particular application of the present invention is to prevent the completion fluids inside the wellbore from being lost into the formation. Once a zone has been completed, particularly with completions utilizing sand control methods such as gravel packing, there may no longer be a filter cake on the formation face with sufficient integrity to hold the hydrostatic pressure in the wellbore. Completion fluids within the wellbore, can leak off into the formation in a process commonly known as "fluid loss". The loss of completion fluids can lead to the reduction of hydrostatic pressure on the completed zone, enabling the wellbore to fill with formation fluids and, if not contained, release into the atmosphere. If fluid loss occurs when completion activities are in operation, such as completing another zone, pulling a work string out of the well or running a production string in the well, there is the chance of losing well control and potentially experiencing a blow-out. The isolation of a previously completed zone provides for well control during subsequent operations, reducing the risks associated with this activity.

In some instances completion activities can be performed while fluid is continually added to the wellbore to maintain a hydrostatic head on the formation, but this method increases the time, equipment and expense required. Injecting additional fluids may also have harmful effects on the producing formation, such as the swelling of water sensitive clays or introducing contaminants such as sulfide reducing bacteria. With the present invention the upper zone is isolated upon the removing of certain well tubulars thereby preventing the well control problems caused by fluid loss.

One method that is often used to reduce the fluid loss into the producing zone is to place a material having physical properties or additives that make it less likely to pass into the producing formation. A physical property, such as a high viscosity, will tend to restrict the material from passing through the formation. Materials such as cottonseed hulls, shredded paper or plastic fibers are sometimes added to restrict fluid loss. This quantity of material is called a fluid loss control pill. With the present invention, the need to place a fluid loss control pill is reduced, saving the cost of rig time and the cost of pill material. The reservoir damage resulting from the spotting of fluid control pills is also reduced, so the need for subsequent remedial work to correct the damage is reduced, thus saving the cost of rig time, the cost of treatment materials and services, and the loss of production during this time period.

Another benefit of the present invention is that the various components of the invention currently exist and have been utilized within the art.

Some of the discussion and illustrations within this application refer to a vertical wellbore that has casing cemented in place and comprises casing perforations to enable communication between the wellbore and the productive formation. The present invention can also be utilized to complete wells that are not cased and likewise to wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A zonal isolation assembly for completing a first zone in a subterranean wellbore, the zonal isolation assembly comprising:

an inner housing;

a sliding sleeve disposed within the inner housing that is capable of moving between an open and closed position;

a passageway providing fluid communication between the inside and outside of the inner housing; and an isolation tubing element at least partially disposed within the inner housing and capable of moving between an upper position and a lower position;

wherein when the sliding sleeve is in its closed position and the isolation tubing element is in its lower position, fluid communication from the first zone through the isolation assembly is restricted.

2. The assembly of claim 1, wherein the isolation tubing element is releasably attached to the inner housing.

3. The assembly of claim 1, wherein the isolation tubing element comprises a sealing element adapted to seat within a receptacle when the isolation tubing element is in its lower position.

4. The assembly of claim 3, wherein the receptacle is attached to a lower packer.

5. The assembly of claim 3, wherein the receptacle is releasably attached to the lower packer.

6. The assembly of claim 3, further comprising:

an upper packer;

an outer housing connected to the upper packer and to the lower packer, the outer housing comprising a wall having a passageway therethrough, the outer housing connected to the inner housing and the passageway located above the inner housing and below the upper packer;

a sliding sleeve disposed within the outer housing capable of moving between an open and closed position, the sliding sleeve located above the inner housing; and the outer housing further comprising a sand screen, the sand screen located below the inner housing.

7. The assembly of claim 6, wherein the inner housing is releasably attached to the outer housing.

8. The assembly of claim 6, wherein the inner housing, isolation tubing element and receptacle are releasably disposed within the outer housing.

9. The assembly of claim 6, wherein when the isolation tubing element is in its upper position, the isolation tubing element is capable of providing fluid communication between the area within the inner housing and the sand screen.

10. The assembly of claim 6, wherein when the isolation tubing element is in its lower position, the isolation tubing element is capable of providing fluid communication between the area within the inner housing and the area below the lower packer.

11. The assembly of claim 6, wherein when the isolation tubing element is in its lower position and the sliding sleeve disposed within the inner housing is in its closed position, fluid communication through the sand screen is restricted.

12. The assembly of claim 6, wherein when the isolation tubing element is in its lower position and the sliding sleeve disposed within the inner housing is in its closed position, the isolation tubing element is capable of providing fluid communication between the area within the outer housing located above the inner housing and the area below a lower packer.

13. The assembly of claim 12, wherein when the sliding sleeve disposed within the outer housing is in its open position, fluid communication can occur through the passageway in the outer housing, and when the sliding sleeve is in its closed position, fluid communication through the passageway in the outer housing is restricted.

14. The assembly of claim 13, wherein when the sliding sleeve disposed within the outer housing is in its open position, fluid communication for a gravel laden slurry can occur through the passageway in the outer housing.

15. The assembly of claim 13, wherein when the isolation tubing element is in its lower position, and the sliding sleeve disposed within the inner housing is in its closed position, and the sliding sleeve disposed within the outer housing is in its closed position, the first zone of the wellbore is isolated from the wellbore located below the set lower packer.

16. The assembly of claim 13, wherein when the isolation tubing element is in its lower position, and the sliding sleeve disposed within the inner housing is in its closed position, and the sliding sleeve disposed within the outer housing is in its closed position, the first zone of the wellbore is isolated from the wellbore located above the set upper packer.

17. The assembly of claim 13, further comprising:

a gravel pack adapter releasably seated within the upper packer, the gravel pack adapter comprising a work string and a crossover assembly, the work string being in fluid communication with the area within the outer housing above the inner housing, and the crossover assembly being in fluid communication with the isolation tubing element.

18. The assembly of claim 17, wherein when the isolation tubing element is in its upper position, and the sliding sleeve disposed within the outer housing is in its open position, the gravel pack adapter work string is capable of communicating a gravel laden slurry through the passageway in the outer housing to the annulus area between the wellbore and the sand screen, and the crossover assembly is capable of communicating slurry returns between the sand screen and the annulus area between the work string and the wellbore above the upper packer.

19. The assembly of claim 17, wherein the gravel pack adapter is capable of shifting the sliding sleeve in the outer housing from an open position to a closed position upon the removal of the gravel pack adapter from the upper packer.

20. The assembly of claim 13, further comprising:

a dual flow adapter releasably seated within the upper packer, the dual flow adapter comprising a first flow tubing and a second flow tubing, wherein when the dual flow adapter is seated within the upper packer the first flow tubing is in fluid communication with the area within the outer housing above the inner housing and the second flow tubing is in fluid communication with the isolation tubing element.

21. The assembly of claim 20, wherein the dual flow adapter is capable of shifting the sliding sleeve in the outer housing from an open position to a closed position when the dual flow adapter is inserted into the upper packer.

22. The assembly of claim 20, wherein when the isolation tubing element is in its lower position, and the sliding sleeve disposed within the inner housing is in its open position, and the sliding sleeve disposed within the outer housing is in its closed position, the first zone of the wellbore is in fluid communication with the first flow tubing and the wellbore located below the lower packer is in fluid communication with the second flow tubing.

23. The assembly of claim 20, wherein the second flow tubing is capable of shifting the sliding sleeve within the inner housing from an open position to a closed position when the second flow tubing is removed from the wellbore.

24. The assembly of claim 20, wherein the second flow tubing is capable of shifting the sliding sleeve within the inner housing from a closed position to an open position when the dual flow adapter is placed within the upper packer.

25. A completion assembly for completing a wellbore comprising:

an outer housing;

an inner housing disposed within and attached to the outer housing;

a first sliding sleeve disposed within the outer housing capable of moving between an open and closed position;

a second sliding sleeve disposed within the inner housing capable of moving between an open and closed position;

an isolation tubing at least partially disposed within the inner housing and capable of moving between an upper and lower position; and a sand screen disposed within the outer housing located below the inner housing;

wherein when the first sliding sleeve is in its open position, fluid communication between the inside and the outside of the outer housing capable of passing a gravel pack slurry is created; and wherein when the isolation tubing is in its upper position, gravel pack fluid returns are capable of passing through the sand screen, through the isolation tubing and to the surface.

26. The completion assembly of claim 25, wherein when the isolation tubing is in its lower position and the first and second sliding sleeves are in their closed positions, the sand screen is isolated from the wellbore above the gravel pack assembly.

27. The completion assembly of claim 25, wherein when the isolation tubing is in its lower position and the first and second sliding sleeves are in their closed positions, the sand screen is isolated from the wellbore below the gravel pack assembly.

28. The completion assembly of claim 25, wherein the inner housing is releasably attached to the outer housing.

29. The completion assembly of claim 25, wherein the isolation tubing is releasably attached to the inner housing.

30. A method for completing a dual well comprising:

completing a lower zone below a lower packer;

providing an upper zone completion assembly comprising an upper packer, an outer housing comprising a gravel pack port, a sand screen and a seating element, and an inner housing comprising a production port and an isolation tubing capable of moving between an upper position and a lower position and capable of seating within a receptacle attached to the lower packer;

attaching the upper zone completion assembly to the lower packer, the isolation tubing being in its upper position;

setting the upper packer;

gravel packing the upper zone by flowing a gravel slurry through the gravel pack port and flowing fluid returns up through the isolation tubing; and isolating the upper zone from the rest of the well by closing the gravel pack port, the production port, and by lowering and seating the isolation tubing within the lower packer receptacle.

31. The method of claim 30, wherein fluid communication between the lower zone and the surface is provided through the isolation tubing.

32. The method of claim 30, further comprising:

inserting a dual flow adapter connected to a first tubing string and a second tubing string into the well and seating the dual flow adapter into the upper packer;

providing fluid communication between the first tubing string and the lower zone through the isolation tubing; and providing fluid communication between the second tubing string and the upper zone through the production port within the inner housing.

33. A method for isolating the upper zone in a dual completion wellbore comprising:

providing an upper zone completion assembly comprising an inner housing, the inner housing comprising a production port and a sliding sleeve, the sliding sleeve capable of moving between an open position and a closed position, wherein when the sliding sleeve is in its closed position, fluid communication through the production port is restricted; and isolating the upper zone by mechanically shifting the sliding sleeve from the open position to the closed position, thereby restricting fluid communication through the production port.

34. The method of claim 33, wherein when the upper zone is isolated, fluid communication between the wellbore below the upper zone completion assembly and the wellbore above the upper zone completion assembly can occur through the upper zone completion assembly.

35. The method of claim 33, further comprising:

reestablishing upper zone production capability by mechanically shifting the sliding sleeve from the closed position to the open position, thereby enabling fluid communication through the production port.

36. A subterranean wellbore completion and production method for an upper zone in a dual well comprising:

providing a completion assembly comprising an inner and outer housing, a first sliding sleeve and a sand screen disposed within the outer housing, a second sliding sleeve disposed within the inner housing, and an isolation tubing capable of moving between an upper position and a lower position that is at least partially disposed within the inner housing;

positioning the completion assembly within the wellbore with the isolation tubing in its upper position;

gravel packing the wellbore by flowing a gravel slurry through the first sliding sleeve and taking fluid returns up through the isolation tubing;

lowering the isolation tubing to its lower position; and isolating the upper zone by having both the first sliding sleeve and the second sliding sleeve in their closed positions.

37. The method of claim 36, further comprising:

producing the upper zone through the sand screen and through the second sliding sleeve.

38. The method of claim 36, further comprising:

producing a lower zone through the isolation tubing.

39. The method of claim 36, further comprising:

separately producing the upper zone through the sand screen and the second sliding sleeve, and a lower zone through the isolation tubing.

40. The method of claim 36, wherein the outer housing is attached to and located below an upper packer and above a lower packer.

41. The method of claim 40, wherein when the isolation tubing is in its lower position it seats within a receptacle attached to the lower packer.

42. The method of claim 40, further comprising:

providing a dual flow adapter connected to a first and second tubing strings;

inserting the dual flow adapter into the upper packer, wherein the second tubing string is seated within the inner housing;

producing the upper zone through the sand screen, the second sliding sleeve, and the first tubing string; and producing the lower zone through the lower packer, the isolation tubing, and the second tubing string.

* * * * *